US005320320A

United States Patent [19]

Thompson

[11] Patent Number: 5,320,320

[45] Date of Patent: Jun. 14, 1994

[54] CLAMPING APPARATUS FOR POSITIONING A PRINTING SCREEN OVER A SCREEN TABLE

[76] Inventor: Carl D. Thompson, Box 213, Arlington, Kans. 67514

[21] Appl. No.: 885,144

[22] Filed: May 18, 1992

Related U.S. Application Data

[63] Continuation of Ser. No. 225,230, Jul. 28, 1988, Pat. No. 5,117,751.

[51] Int. Cl.[5] ..... A47G 1/10

[52] U.S. Cl. ..... 248/316.1; 248/292.1; 248/286; 248/364; 269/91

[58] Field of Search ..... 248/316.1, 316.4, 316.6, 248/316.8, 364, 123.1, 280.1, 286, 292.1, 274; 101/127.1, 128.1, 123; 269/91, 152, 71, 92, 93, 94

[56] References Cited

U.S. PATENT DOCUMENTS

| | | | |
|---|---|---|---|
| 2,397,731 | 4/1946 | Fowler | 101/123 |
| 2,796,831 | 6/1957 | Heestand | 101/127.1 X |
| 2,912,206 | 11/1959 | Ferris et al. | 248/229 |
| 2,995,823 | 8/1961 | Bowen | 269/93 |
| 3,286,744 | 11/1966 | Stall et al. | 269/91 |
| 3,608,854 | 9/1971 | Hamu | 248/316.1 |
| 3,837,060 | 9/1974 | Stehling | 269/152 X |
| 4,041,861 | 8/1977 | Alter | 101/127.1 X |
| 4,063,502 | 12/1977 | Cunningham | 101/123 |
| 4,073,232 | 2/1978 | Brewer | 101/128.1 X |
| 4,129,076 | 12/1978 | Gardner | 101/127.1 X |
| 4,388,862 | 6/1983 | Thomas, Jr. | 101/128.1 X |
| 4,702,450 | 10/1987 | Barisa | 248/123.1 X |
| 4,735,393 | 4/1988 | Albee, Jr. | 248/316.1 X |
| 4,896,451 | 1/1990 | K'o | 248/231.4 X |
| 4,949,635 | 8/1990 | Padula | 101/128.1 X |
| 4,972,773 | 11/1990 | Barlow | 101/127.1 |
| 5,044,505 | 9/1991 | Spratt | 211/189 X |

*Primary Examiner*—David A. Scherbel
*Assistant Examiner*—Korie H. Chan
*Attorney, Agent, or Firm*—John W. Carpenter

[57] ABSTRACT

A clamping apparatus for use in screen printing operations. The clamping apparatus has an angle iron having an upright back, a lower lip bound to the upright back, and an upper lip bound to the upright back. At least one clamp slide assembly is slidably disposed on and along the upper lip of the angle iron. The clamping apparatus is pivotally secured to a silkscreen table in order for readily engaging a silkscreen frame. A method for positioning a printing screen over a screen table which includes clamping with a pair of clamp slide assemblies a silkscreen frame of a printing screen against the lower lip of the angle iron. The silkscreen frame may be easily elevated as desired.

15 Claims, 9 Drawing Sheets

FIG. 14
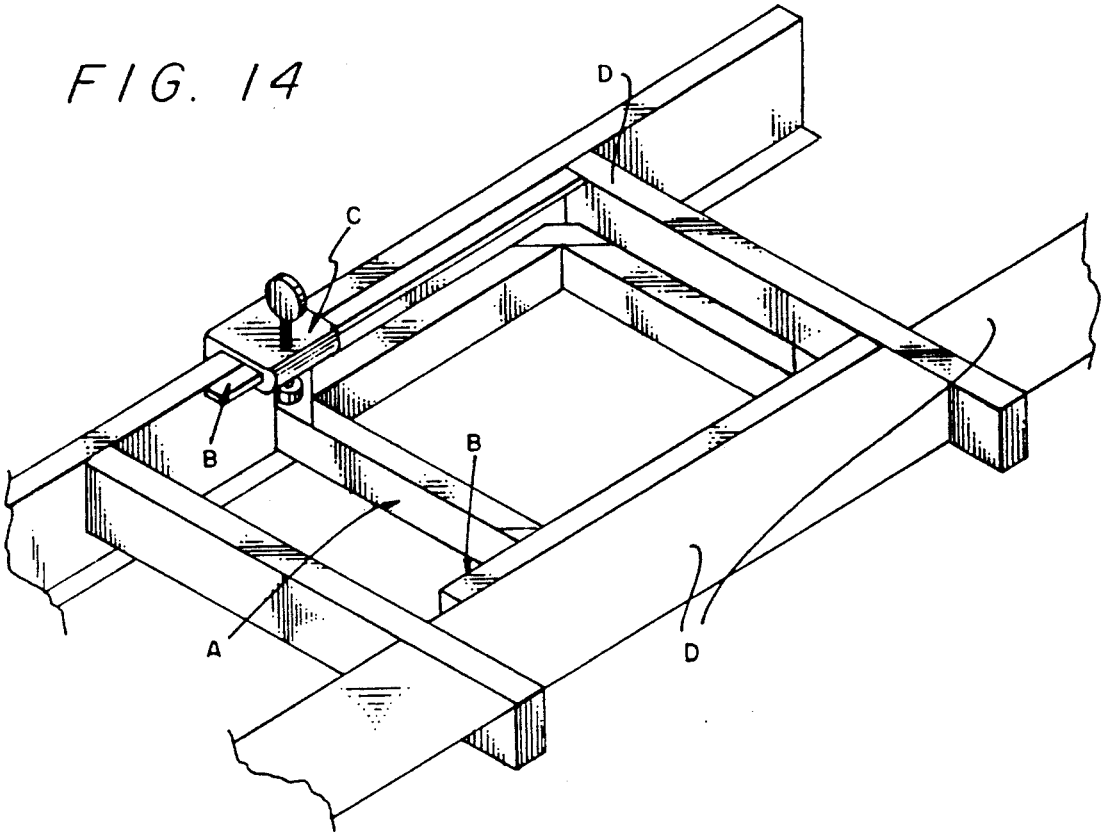
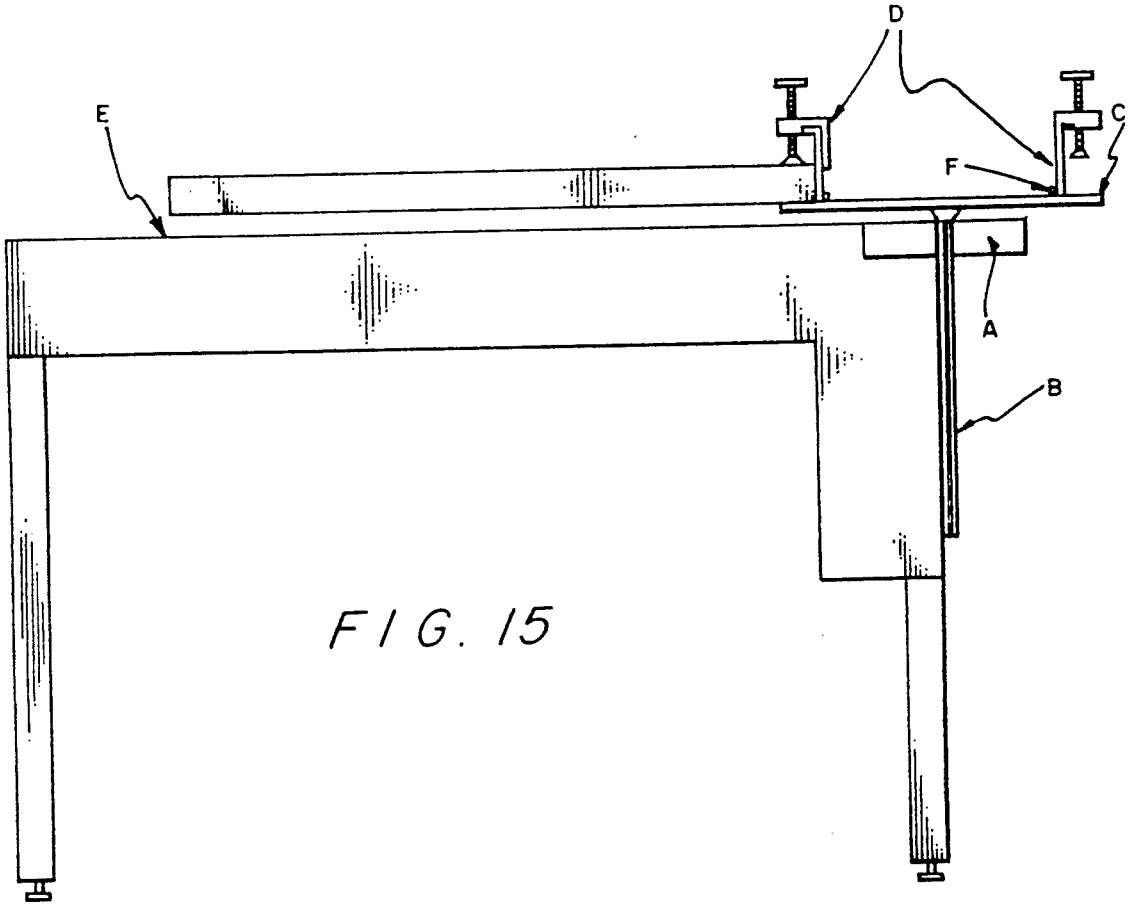
FIG. 15

FIG. 16
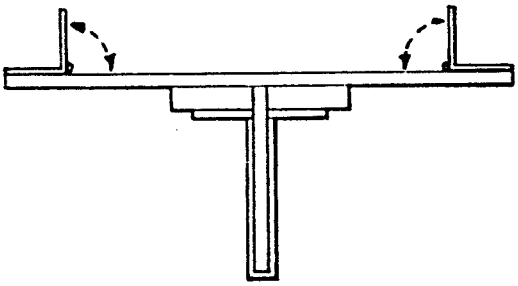
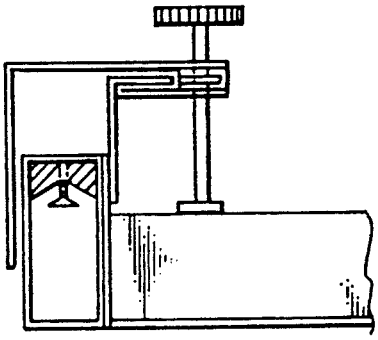
FIG. 17
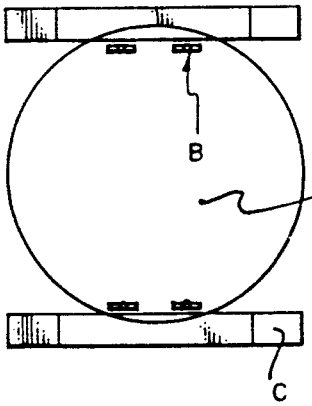
FIG. 18
FIG. 19
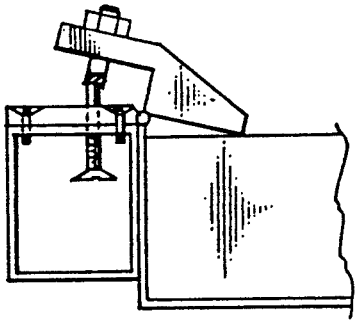
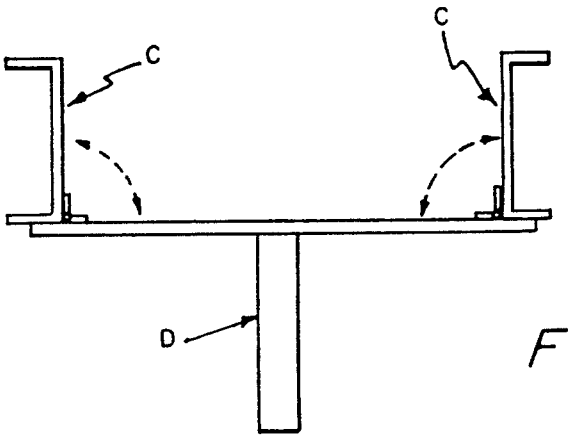
FIG. 20

CLAMPING APPARATUS FOR POSITIONING A PRINTING SCREEN OVER A SCREEN TABLE

This is a continuation application of copending application Ser. No. 07/225,230, filed Jul. 28, 1988 which is now U.S. Pat. No. 5,117,751.

FIELD OF THE INVENTION

This invention is related to an apparatus for clamping. More specifically, this invention provides an apparatus for clamping, and a method for positioning a printing screen over a screen table.

DESCRIPTION OF THE PRIOR ART

A patentability investigation was conducted and the following United States patents were discovered: U.S. Pat. No. 2,796,831 to Heestand and entitled "Printing Screen Registering Device"; U.S. Pat. No. 4,041,861 to Alter and entitled "Screen Printing Frame with Floating Stretch-Clamps"; U.S. Pat. No. 4,073,232 to Brewer and entitled "Screen Printing Apparatus"; U.S. Pat. No. 4,388,862 to Thomas entitled "Apparatus for Silkscreen Printing"; and U.S. Pat. No. 4,694,746 to Hamu and entitled "Silkscreen Frame Mounting Assembly for Press". The foregoing prior art is incorporated herein by reference thereto, and none of the foregoing prior art teach or suggest the particular clamping apparatus of this invention. Nor does any of the foregoing prior art teach or suggest the particular method for positioning a printing screen over a screen table.

SUMMARY OF THE INVENTION

The present invention accomplishes its desired objects by broadly providing a clamping apparatus which includes an angle iron means having an upright back means, a lower lip means bound to the upright back means, and an upper lip means bound to the upright back means and having an upper lip top and an upper lip bottom. At least one clamp means is slidably disposed along the upper lip means. A plurality of hinge means is pivotally secured to the lower lip means. The clamp means preferably comprises a generally L-shaped bracket means having a bracket back means that slidably contacts the upright back means of the angle iron means when the clamp means is slidably disposed along the upper lip means. The clamp means additionally includes a bracket head means bound to the bracket back means. The bracket head means is slidably positioned along the upper lip top of the upper lip means. The clamp means still further includes a clamp lip means supported by the bracket head means and extending in slidable contact with the upper lip bottom. A clamping screw means threadably passes through the bracket head means and the clamp lip means in order to releasably engage a silk printing screen which is to be positioned on or over a screen table. Secured to the upright back means of the angle iron means of the angle iron means is a counterbalance means.

The present invention further accomplishes its desired objects by broadly providing a method for positioning a printing screen over a screen table. Initially, the angle iron assembly is formed to have an upright back, a lower lip bound to the upright back, and an upper lip bound to the upright back. As was indicated above, the upper lip has an upper lip top and an upper lip bottom. A pair of clamp means is slidably mounted along the upper lip means. The lower lip means of the angle iron assembly means is pivoted to a screen table means; and the pair of clamp means clamps a printing screen means against the lower lip means. The method additionally comprises the steps of securing a counterbalance means to the upright back means, and passing threadably at least one pin means through the upper lip means in order to prevent the slant means from sliding off of the upper lip means. Clamping of the printing screen means against the lower lip means by the pair of clamp means preferably comprises positioning the pair of clamp means against a pair of screen brackets having rotatably affixed thereto cylindrical frame rollers, and affixing rigidly the pair of screen brackets between the pair of clamp means and the lower lip means of the angle iron assembly means.

It is therefore an object of the present invention to provide a clamping apparatus which is to be primarily used for positioning a printing screen over a screen table.

It is another object of the present invention to provide a method for positioning a printing screen over a screen table.

These, together with the various ancillary objects and features which will become apparent to those skilled in the art as the following description proceeds, are attained by this novel clamping apparatus and process, a preferred embodiment being shown with respect to the accompanying drawings, by way of example only, wherein:

BRIEF DESCRIPTION OF THE DRAWINGS

FIG. 14 is a perspective view disclosing a silkscreen frame A, a top angle rail B that clamp C will slide on horizontally, an adjustable clamp C, and a press screen adaptor D;

FIG. 15 is a side elevational view disclosing a rotating bearing A, a shaft support B, a revolving clamp support C, clamps D, a table top E, and/or substrate surface, a hinge F on the outside of channel end welded to revolving clamp supports (for textile printing);

FIG. 16 is a side elevational view disclosing a bearing support and/or retaining tube disposed within a rotating frame adaptor, and is a side elevational view of a revolving clamp support of the revolving clamp support in FIG. 15 and more particularly discloses the pivotally connected hinge and how the clamps must face in an outward position;

FIG. 17 is a side elevational view of the clamping apparatus of this invention with the width of the top angle increased to slide a press rail therebetween as illustrated therein;

FIG. 18 is a view disclosing a revolving clamp A support, hinges B, and outward facing U channel C to receive adjustable slide clamp.

FIG. 19 is a side elevational view of the clamping apparatus engaged with the frame of a screen;

FIG. 20 is a side elevational view of the assembly of FIG. 18.

DETAILED DESCRIPTION OF THE INVENTION

Figure 1:
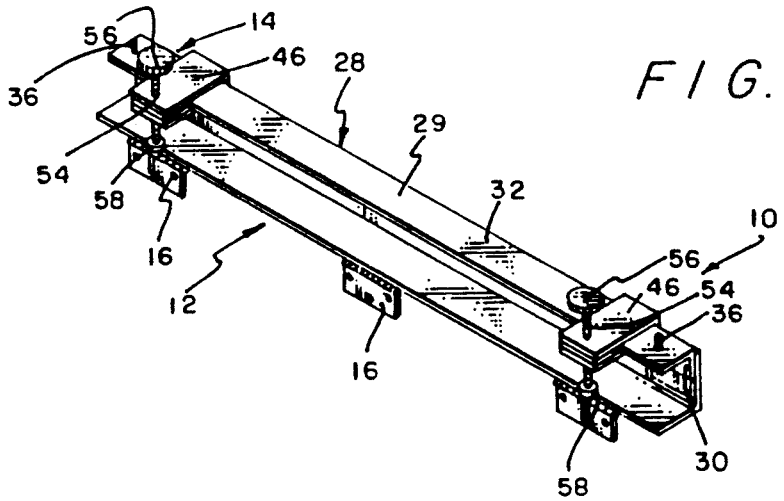
FIG. 1 is a perspective view of the clamping apparatus of this invention.
Figure 2:
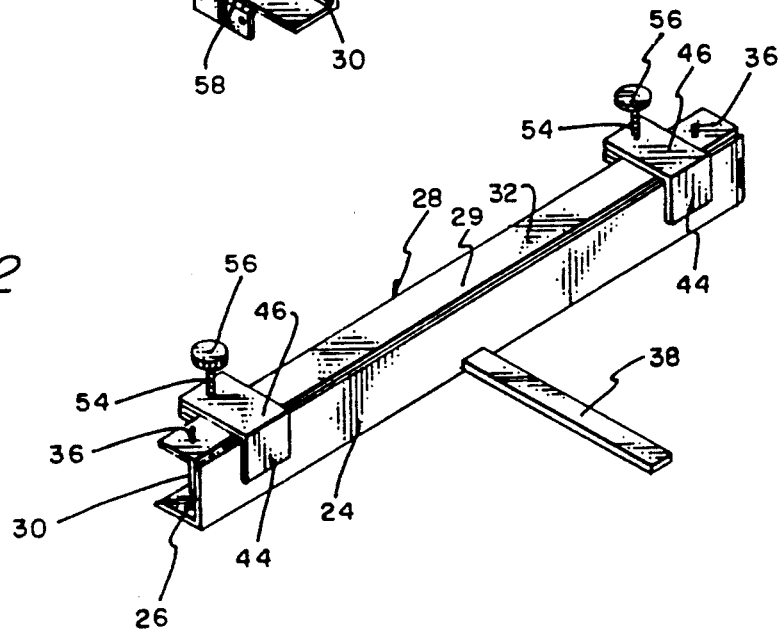
FIG. 2 is a perspective view of the rear of the clamping apparatus.
Figure 3:
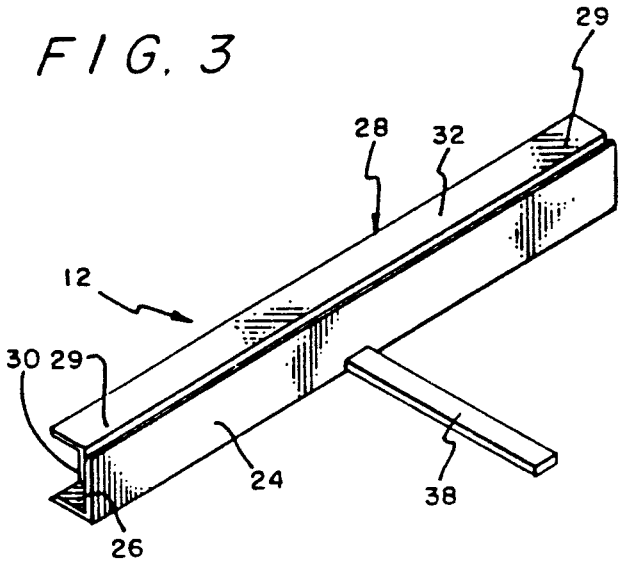
FIG. 3 is a perspective view of the rear of the base assembly of the clamping apparatus.

Referring in detail now to the drawings wherein similar parts of the invention are identified by like reference numerals, there is seen the clamping apparatus, generally illustrated as 10. As best seen in FIGS. 1-6, the clamping apparatus 10 has a base assembly, generally illustrated as 12, and a pair of clamping slide assemblies 14-14 slidably mounted to the base assembly 12. A plurality of hinges 16 is secured to the base assembly 12 and to a silkscreen table 18 that is supported by connecting legs 20. The hinges 16 provide for the pivoting of the base assembly 12 about an edge 22 of the silkscreen table 18.

Figure 7:
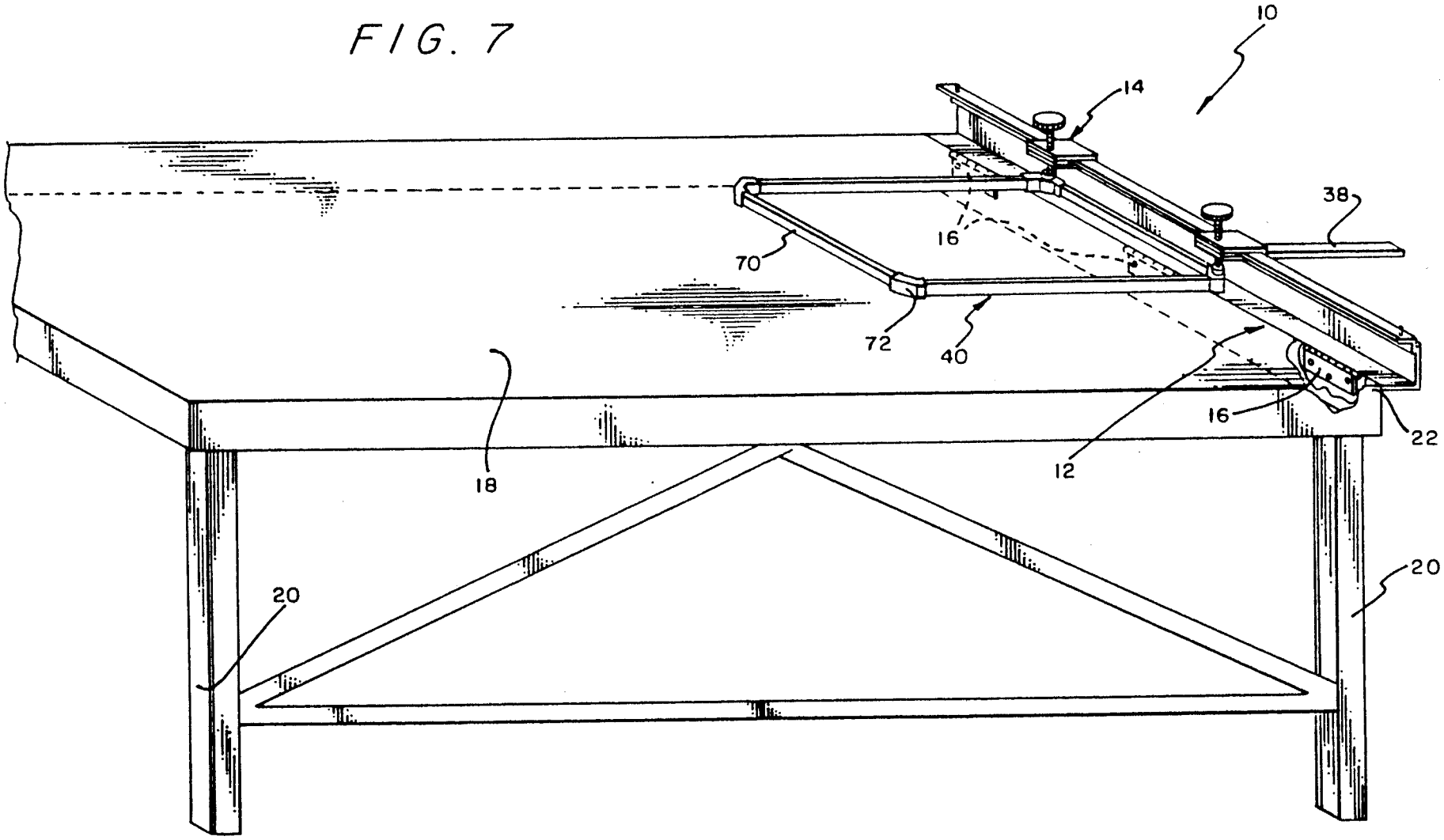
FIG. 7 is a perspective view of the clamping apparatus of this invention pivotally mounted to a silkscreen table with a pair of clamp slide assemblies engaged to a silkscreen frame.
Figure 8:
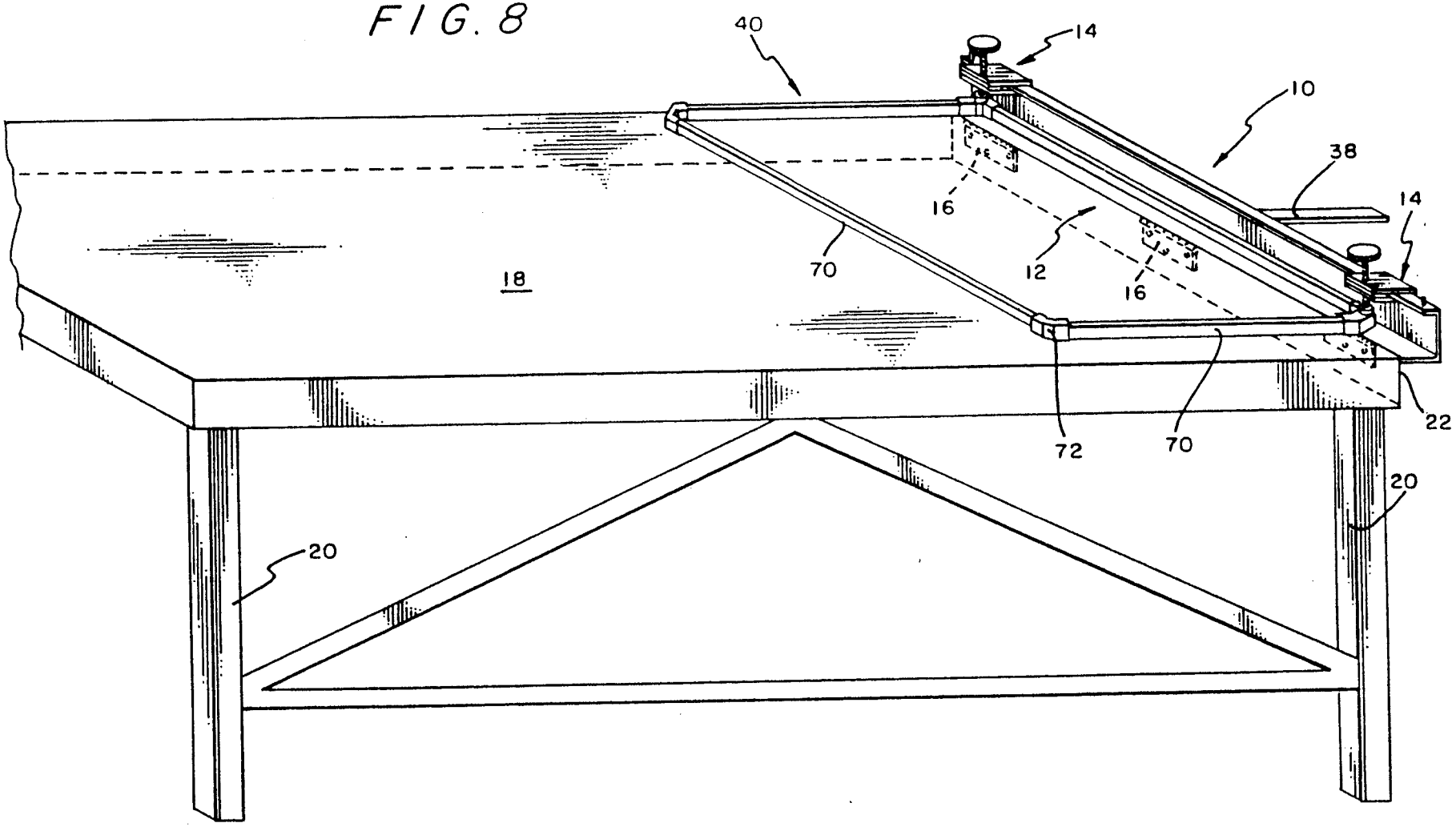
FIG. 8 is a perspective view of the clamping apparatus of this invention pivotally mounted to a silkscreen table and having the pair of clamp slide assemblies slidably positioned in close proximity to the end of of the base assembly in order to engage a silkscreen frame that is longer than the silkscreen frame in FIG. 7.
Figure 9:
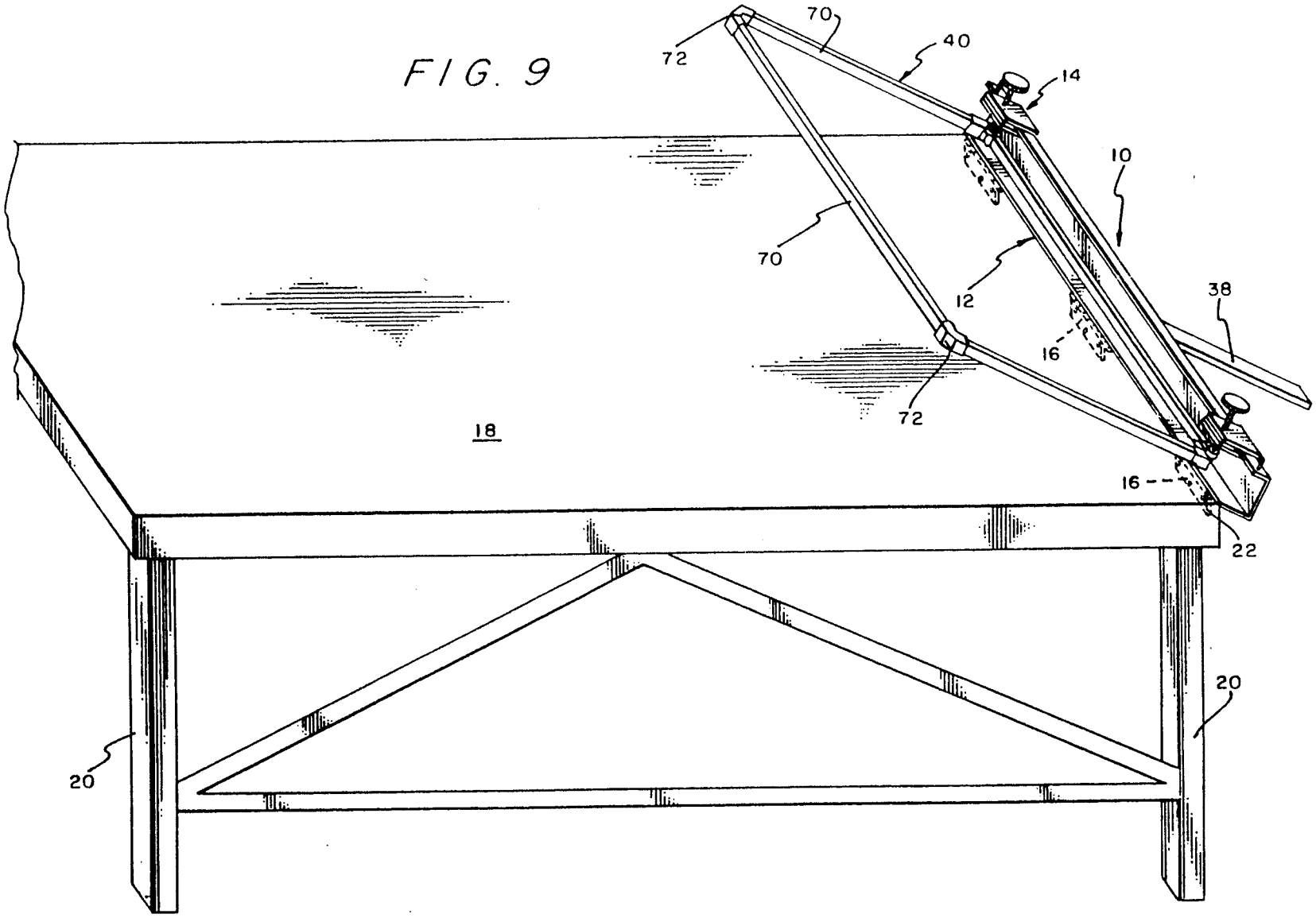
FIG. 9 is a perspective view of the clamping apparatus of FIG. 8 with the silkscreen frame engaged by the clamping apparatus in an elevated position and with the counterbalance member 38 of the base assembly balancing the silkscreen frame in the elevated position.

The base assembly 12 has a back 24, a lower lip 26 integrally bound to the back 24, and an upper lip means, generally illustrated as 28, secured to the back 24. Preferably, the upper lip means 28 is not as wide as the lower lip 26, and is L-shaped (see FIG. 6) with a lip back 30 that connects to the back 24 of the base assembly 12. The upper lip means 28 also has a planar lip structure 29 perpendicular to the lip back 30 and having a lip top 32 and a lip bottom 34 (see FIG. 6). A pair of pins 36—36 threadably pass through the planar lip structure 29 and provide a means for preventing the slide assemblies 14—14 from slipping off of the base assembly 12; more specifically, as will be seen below, from slipping off of the planar lip structure 29 of the upper lip means 28. A counterbalance member 38 is mounted to the back 24 of the base assembly 12. The counterbalance member 38 functions to balance the clamping apparatus 10 when a printing screen means, generally illustrated as 40 in FIGS. 7-10, is elevated off or away from the silkscreen table 18, as illustrated in FIG. 9.

Figure 4:
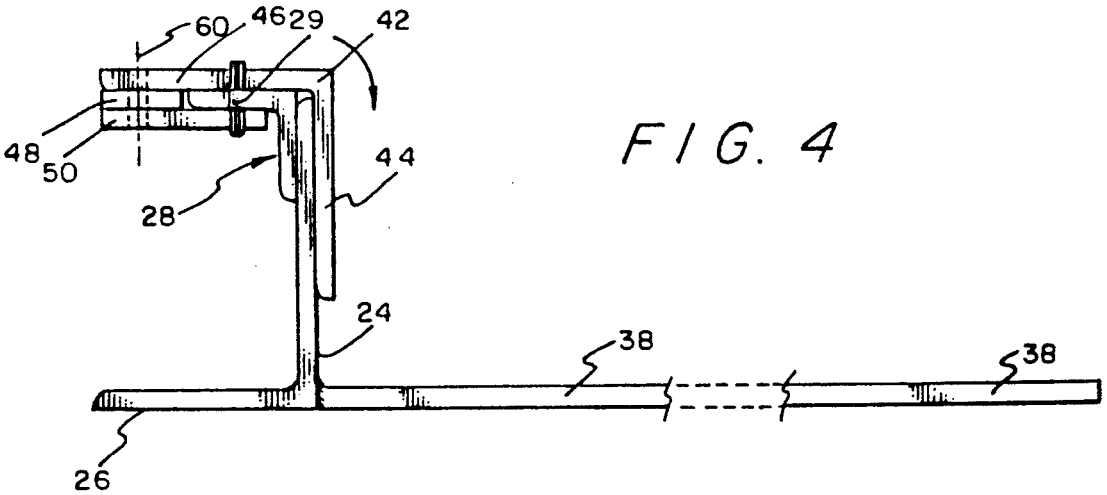
FIG. 4 is a vertical sectional view of the base assembly having the clamp slide assembly slidably mounted thereto with the clamp screw removed from the clamp slide assembly.
Figure 5:
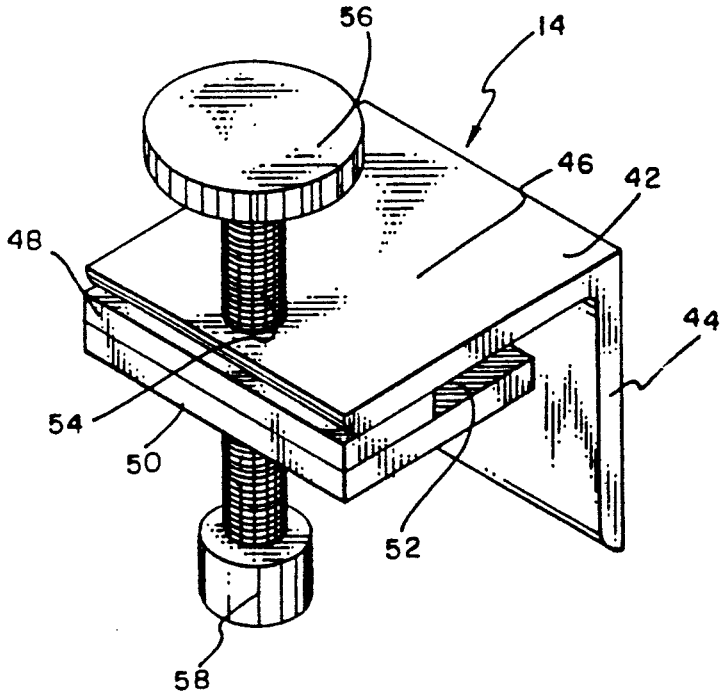
FIG. 5 is a perspective view of the clamp slide assembly.
Figure 6:
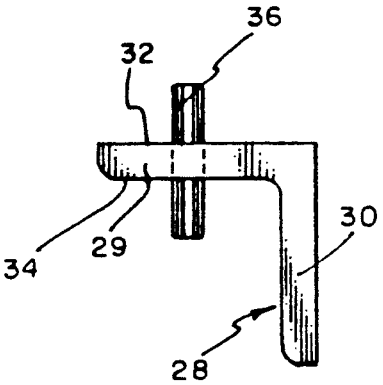
FIG. 6 is a side elevational view of the upper lip means of the base as having a pin threadably passing therethrough

Each of the clamp slide assemblies 14—14 comprises an L-shaped bracket 42 having a bracket back 44 and a bracket head 46 that integrally connects to the bracket back 44 in a normal fashion. When the clamp slide assemblies 14—14 are slidably mounted to the base assembly 12, the bracket back 44 slidably contacts the back 24 of the base assembly 12 and the bracket head 46 is slidably disposed on or along the lip top 32 of the planar lip structure 29 (see FIG. 4). A plate member 48 connects to the bottom of the bracket head 46, and a clamp lip 50 is bound to the plate member 48 in order to be supported in a spaced relationship with respect to the bracket head 46 to define a channel 52 (see FIG. 5) wherethrough the planar lip structure 29 of the upper lip means 28 slidably lodges. Threadably passing through the bracket head 46, the plate member 48, and the clamp lip 50 is clamp screw 54 having a clamp head 56 and a clamp foot 58. As indicated in FIG. 4, the bracket head 46, the plate member 48, and the clamp lip 50 are formed with threaded apertures that register along center line 60 in FIG. 4 for threadably receiving the clamp screw 54. When the clamp screw 54 is firmly engaging the printing screen means 40 as in FIGS. 7-9, torque in direction of the arrow T in FIG. 4 is developed which prevents the clamp slide assembly 14 from readily sliding along the planar lip structure 29 of the upper lip means 28 and along the back 24 of the base assembly 12. The torque more specifically causes the bracket back 44 to be in frictional contact with the base assembly back 24, along with the bracket head 49 and the clamp lip 50 frictionally engaging the planar lip structure 29. The clamping apparatus 10 of this invention is ideally suited for stencil screen printing operations. The prior art of stencil screen printing, often referred to as silkscreen printing, is well known and widely used for a wide variety of printing applications. Briefly stated, silkscreen printing is performed with the aid of a stencil screen or printing screen to which a stencil pattern is applied in any convenient conventional manner. Silk cloth was originally used as the stencil screen and hence the name silkscreen printing evolved. A variety of other stencil screen materials has been developed, however, and are used today although the name "silkscreen printing" still persists.

In the stencil screen printing process, the stencil screen is stretched across the open side of a screen stretch frame and placed with one side of the screen in contact with the article to be printed. A suitable printing ink, which may be any printing medium, is spread across the opposite side of the screen. This ink is forced through the screen onto the article to be printed by means of a squeegee to reproduce on the article the stencil pattern on the stencil screen. Multiple color screen prints may be reproduced by performing a number of successive stencil screen printing operations with different color printing inks. An extensive discussion of screen printing operations is in the following publications: *Screen Printing Techniques* by Albert Kosloff, published by THE SIGNS OF THE TIMES Publishing Company, Cincinnati, Ohio; and *Photographic Screen Printing* by Albert Kosloff, published by THE SIGNS OF THE TIMES Publishing Company (copyright 1981), Cincinnati, Ohio. These publications are incorporated herein by reference thereto.

Figure 10:
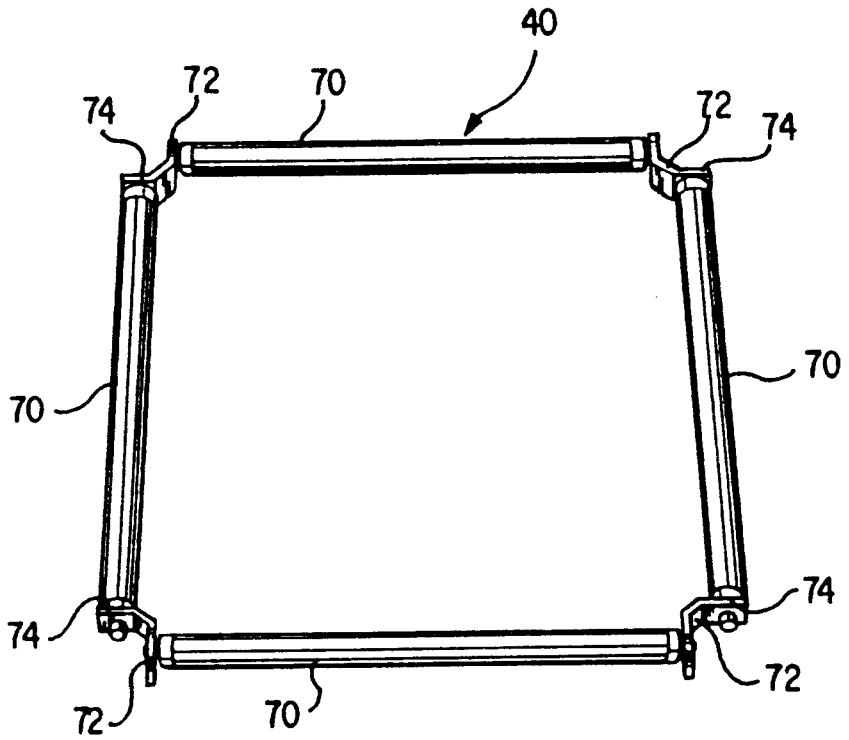
FIG. 10 PRIOR ART
FIG. 10 is a perspective view of a prior art printing screen frame whose borders are formed with cylindrical rollers.
Figure 11:
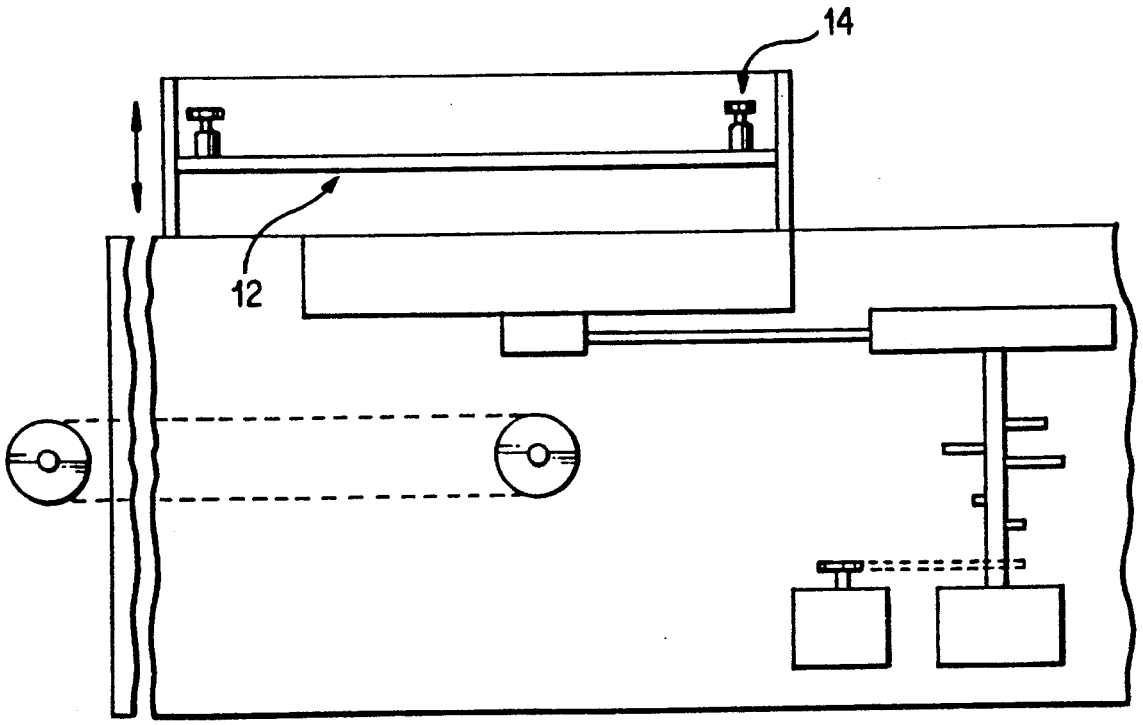
FIG. 11 is a side elevational view of a typical reciprocating flatbed press with a frame in place and clamps attached.
Figure 12:
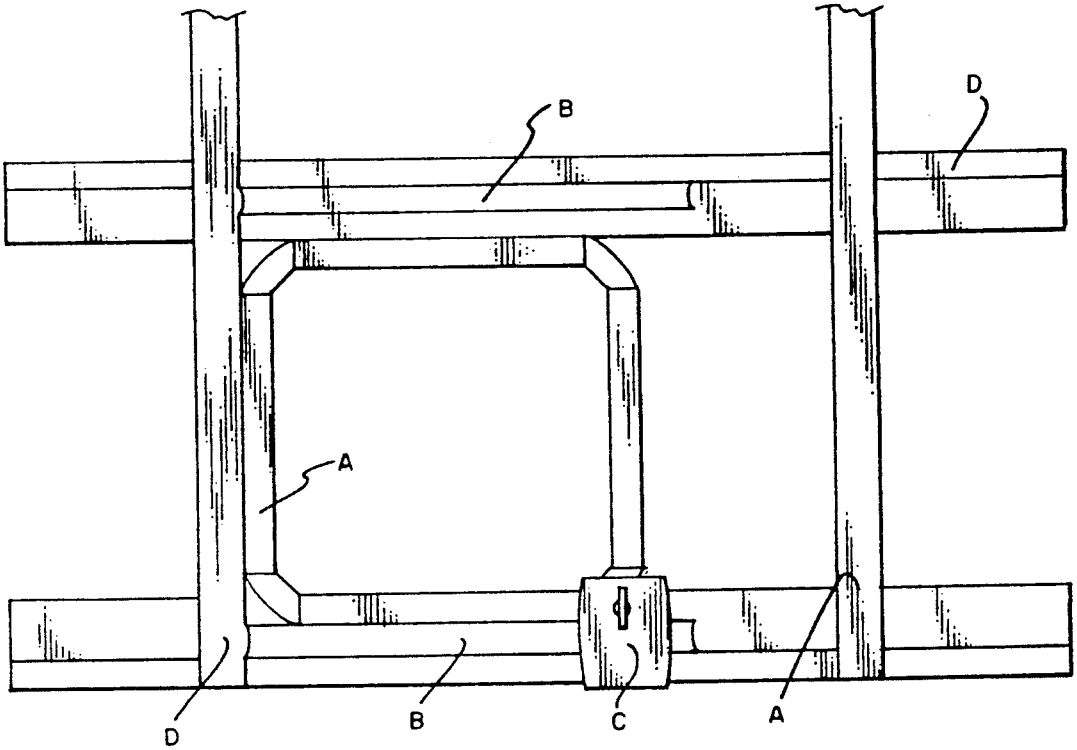
FIG. 12 is a top plan view of a typical press retaining frame comprising a silkscreen frame, an angle attached to the press retaining frame by means of countersunk screws, a welding, an adapting clamp attached to the corners of a tubular frame or other type, and an adapting frame body press.
Figure 13:
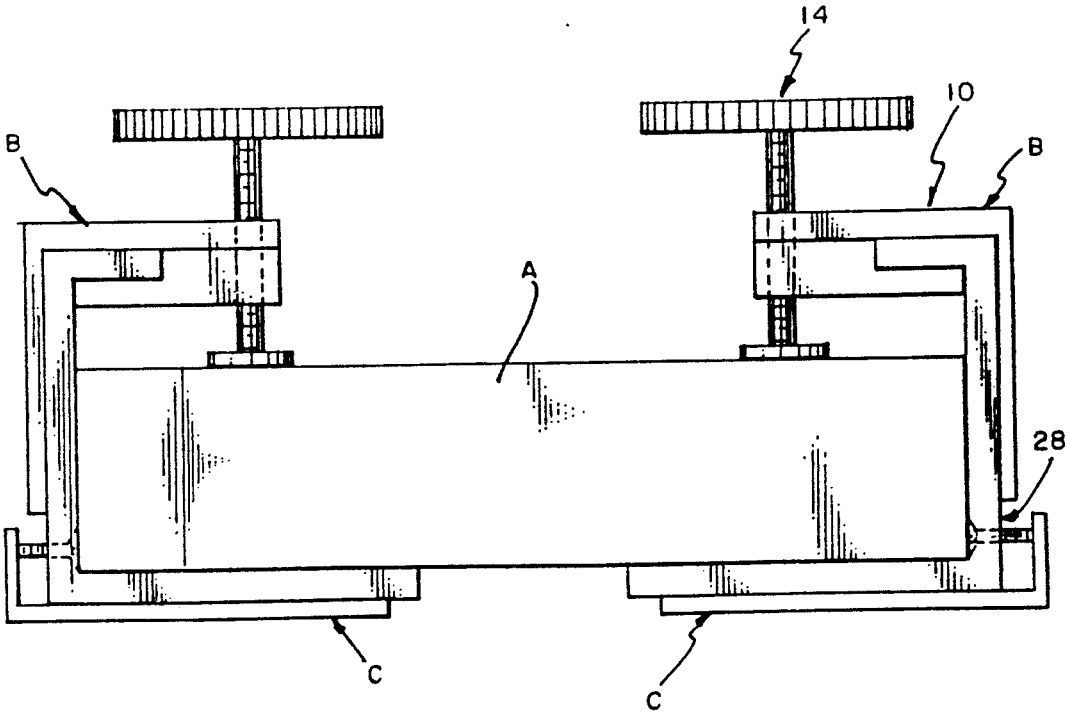
FIG. 13 is a side elevational view showing opposing side clamps, a screen frame attached by the side clamps, side clamps at the corners of the silkscreen frame, and an adapting frame of a typical flatbed press.

The clamping apparatus of this invention is ideally suited for engaging the printing screen means 40 depicted in FIG. 10. The printing screen means of FIG. 10 is known as a Newman Roller frame and comprises cylindrical rollers 70. More specifically, the Newman Roller frame of FIG. 10 has four cylindrical rollers, with each end of a roller rotatably secured to a screen bracket 72. As illustrated in FIG. 10, each screen bracket 72 is generally L-shaped and has a planar bracket surface 74. When the clamping apparatus 10 of this invention engages the printing screen means 40 of FIG. 10, the clamp foot 58 of each of the clamp slide assemblies 14 urgedly engages the planar bracket surface 74. The printing screen means 40, or the Newman Roller frame, of FIG. 10 is designed for stretching any screen fabric (not shown in FIGS. 7–10) accurately through the entire printing area. The fabric is easily adjusted before, during or after printing and may be quickly stretched and quickly removed With continuing reference to the drawings for one operation of the clamping apparatus 10 and for a method for positioning the printing screen means 40 on and/or over the silkscreen table 18, the clamping apparatus 10 is initially formed in accordance with the procedures indicated above. The lower lip means 26 of the angle iron assembly 12 is pivotally secured to an end of the silkscreen table 18 by employment of the hinges 16. The pins 36 are removed from the planar lip structure 29 of the upper lip means 28, and a pair of clamp slide assemblies 14—14 are slid on and along the upper lip means 28; more specifically, along the planar lip structure 29 and the back 24 of the base assembly 12. The clamp slide assemblies 14—14 are separated at a distance which will readily engage the planar bracket surface 74 of the bracket 72 of the printing screen means 40. One of the salient features of this invention is that the clamp slide assemblies 14—14 may be easily slid along the base assembly for engagement with any silkscreen frame of any length. The distance that the clamp slide assemblies 14—14 are separated depends on the length of the silkscreen frame to be engaged.

After the clamp slide assemblies 14—14 are separated at the desired distance, one end of the silkscreen frame of the printing screen means 40 is positioned on top of the lower lip means 26 and the clamp screw means 54 or rotated such that the clamp foot 58 travels downwardly to engage the planar bracket surface 74 of the bracket 72. The other clamp screw means 54 is also rotated such that its clamp foot 58 travels downwardly in order to engage the planar bracket surface 74 of the other bracket 72, as indicated in FIGS. 7 and 8. The pin means 36—36 should be rotatably passed through the upper lip means 28 in order to reposition them therethrough. The affixed printing screen means 40 may be easily elevated by picking up the silkscreen frame. The silkscreen frame will remain in an elevated position (such as that shown in FIG. 9) by the counterbalance member 38. Thus, there is no need for the operator to continually hold the silkscreen frame of the printing screen means 40 in the elevated position.

The clamping apparatus 10 of this invention may be employed in many screen printing operations which are of the small scale and custom order variety. When the clamping apparatus 10 of this invention is used in such an operation, it is capable of handling a very large variety of different printing jobs, and it is readily adjustable from one job to another. The clamping apparatus 10 of this invention is not only versatile and readily adjustable in several different senses, but it is also simple and economical to construct and operate. The clamping apparatus of this invention is ideally suited for the many and varied tasks which a small, non-specialized custom silkscreen printing operation is called upon to accomplish.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. An apparatus for clamping comprising an angle iron means having an upright back means, a lower lip means bound to said upright back means, an upper lip means bound to said upright back means and having an upper lip top and an upper lip bottom; and at least one clamp means slidably disposed along said upper lip means; said clamp means comprises a generally L-shaped bracket means having a bracket back means that slidably contacts said upright back means of said angle iron means and a bracket head means bound to said bracket back means and is slidably positioned along the upper lip top of said upper lip means; a clamp lip means supported by said bracket head means and extending in slidable contact with the upper lip bottom; and a clamping screw means threadably passing through said bracket head means and said clamp lip means.

2. The apparatus of claim 1 additionally comprising at least one hinge means secured to said lower lip means.

3. The apparatus of claim 2 additionally comprising a table means secured to said hinge means.

4. The apparatus of claim 3 additionally comprising a counterbalance member secured to said upright back means.

5. The apparatus of claim 4 wherein said upper lip means has a structure defining a generally L-shaped lip iron with a lip back bound to said upright back means.

6. The apparatus of claim 1 additionally comprising at least one pin member threadably engaged through said upper lip means, and said lower lip means is wider than said upper lip means.

7. The apparatus of claim 1 wherein said clamping screw means comprises a clamp foot positioned at a bottom thereof and a clamp head disposed at a top thereof.

8. The apparatus of claim 7 additionally comprising a plate means secured to the bottom of said bracket head means and to said clamp lip means.

9. An apparatus for clamping comprising an angle iron means for receiving a printing screen and for supporting a clamp means, said angle iron means including a base assembly having an upright back and an upper lip bound to said upright back and having an upper lip top and an upper lip bottom; and at least one clamp means for receiving and engaging a printing screen and slidably disposed along said upper lip; said clamp means comprises a generally L-shaped bracket having a bracket back that slidably contacts said upright back of said base assembly and a bracket head bound to said bracket back and slidably positioned along the upper lip top of said upper lip; a clamp lip supported by said bracket head and extending in slidable contact with the upper lip bottom; and a clamping screw means threadably passing through said bracket head for engaging a printing screen; and said base assembly additionally comprises a lower lip bound to said upright back.

10. The apparatus of claim 9 additionally comprising at least one hinge means secured to said base assembly.

11. The apparatus of claim 10 additionally comprising a table means secured to said hinge means.

12. The apparatus of claim 9 additionally comprising a counterbalance member secured to said upright back.

13. The apparatus of claim 9 additionally comprising at least one pin threadably engaged through said upper lip.

14. The apparatus of claim 9 wherein said clamping screw comprises a clamp foot positioned at the bottom thereof and a clamp head disposed at the top thereof.

15. An apparatus for clamping a printing screen comprising an angle iron means for receiving a printing screen and for supporting a clamp means, said angle iron means including a base assembly having an upright back and an upper lip bound to said upright back and having an upper lip top and an upper lip bottom; and at least one clamp means for receiving and engaging a printing screen and slidably disposed along said upper lip and at least one pin means threadably engaged through said upper lip for preventing the at least one clamp means from slipping off the base assembly; and wherein said clamp means comprises a generally L-shaped bracket having a bracket back that slidably contacts said upright back of said base assembly and a bracket head bound to said bracket back and slidably positioned along the upper lip top of said upper lip; a clamp lip supported by said bracket head and extending in slidable contact with the upper lip bottom; and a clamping screw threadably passing through said bracket head; and wherein said clamping screw comprises a clamp foot positioned at the bottom thereof and a clamp head disposed at the top thereof; and said base assembly additionally comprises a lower lip bound to said upright back.

* * * * *